US007126593B2

(12) United States Patent
Matsumoto

(10) Patent No.: US 7,126,593 B2
(45) Date of Patent: Oct. 24, 2006

(54) DRIVE CIRCUIT INCLUDING A PLURALITY OF TRANSISTORS CHARACTERISTICS OF WHICH ARE MADE TO DIFFER FROM ONE ANOTHER, AND A DISPLAY APPARATUS INCLUDING THE DRIVE CIRCUIT

(75) Inventor: Shoichiro Matsumoto, Oogaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 165 days.

(21) Appl. No.: 10/327,958

(22) Filed: Dec. 26, 2002

(65) Prior Publication Data

US 2003/0142052 A1 Jul. 31, 2003

(30) Foreign Application Priority Data

Jan. 29, 2002 (JP) ..... 2002-020547

(51) Int. Cl.
*G09G 5/00* (2006.01)

(52) U.S. Cl. ..... 345/205; 345/80; 315/169.1

(58) Field of Classification Search ..... 345/76, 345/80, 82, 92, 204–206; 315/169.1, 169.3
See application file for complete search history.

(56) References Cited

U.S. PATENT DOCUMENTS 3,662,210 A 5/1972 Maximov
5,177,406 A * 1/1993 Troxell ..... 315/169.1
5,303,188 A * 4/1994 Kohno ..... 365/189.05
5,517,080 A 5/1996 Budzilek et al.
5,780,351 A 7/1998 Arita et al.
5,945,008 A 8/1999 Kisakibaru et al.
6,075,319 A 6/2000 Kanda et al.
6,093,934 A 7/2000 Yamazaki et al.
6,124,604 A 9/2000 Koyama et al.
6,229,508 B1 5/2001 Kane
6,281,552 B1 8/2001 Kawasaki et al.
6,333,528 B1 12/2001 Arita et al.
6,356,029 B1 3/2002 Hunter
6,400,349 B1 * 6/2002 Nagumo ..... 345/82
6,445,005 B1 * 9/2002 Yamazaki et al. ..... 257/72
6,489,046 B1 12/2002 Ikeda et al.
6,498,438 B1 12/2002 Edwards (Continued)

FOREIGN PATENT DOCUMENTS

CN 1214799 A 4/1999

(Continued)

OTHER PUBLICATIONS

"Al-Mo (Aluminium-Molybdenum)" L.Brewer et al., *Binary Alloy Phase Diagrams* vol. 1 ed. Thaddeus B. Massalski, (Dec. 1980) pp. 133-134.

(Continued)

*Primary Examiner*—Bipin Shalwala
*Assistant Examiner*—Tom Sheng
(74) *Attorney, Agent, or Firm*—McDermott Will & Emery LLP

(57) ABSTRACT

A first transistor and a second transistor which serve as switches are connected with each other in series between a data line and a gate electrode of a third transistor which drives a diode. A characteristic of the first transistor is made to differ in terms of current driving capability from that of the second transistor. A storage characteristic of one of the first transistor and the second transistor is made higher than that of the other transistor whereas the current driving capability of the other transistor is raised, and so that leakage current in the first and second transistors which are connected in series is significantly reduced.

19 Claims, 2 Drawing Sheets

U.S. PATENT DOCUMENTS

| | | | | |
|---|---|---|---|---|
| 6,501,466 | B1 | 12/2002 | Yamagishi et al. | |
| 6,512,504 | B1 * | 1/2003 | Yamauchi et al. | 345/87 |
| 6,525,704 | B1 | 2/2003 | Kondo et al. | |
| 6,528,824 | B1 | 3/2003 | Yamagata et al. | |
| 6,577,181 | B1 * | 6/2003 | Takahashi | 327/538 |
| 6,579,787 | B1 | 6/2003 | Okura et al. | |
| 6,583,581 | B1 | 6/2003 | Kaneko et al. | |
| 6,636,284 | B1 | 10/2003 | Sato | |
| 6,686,693 | B1 | 2/2004 | Ogawa | |
| 6,717,181 | B1 | 4/2004 | Murakami et al. | |
| 6,734,836 | B1 * | 5/2004 | Nishitoba | 345/82 |
| 6,753,834 | B1 | 6/2004 | Mikami et al. | |
| 6,781,567 | B1 | 8/2004 | Kimura | |
| 6,859,193 | B1 * | 2/2005 | Yumoto | 345/82 |
| 6,911,784 | B1 | 6/2005 | Sasaki et al. | |
| 2001/0055878 | A1 | 12/2001 | Chooi et al. | |
| 2002/0041276 | A1 | 4/2002 | Kimura | |
| 2002/0044109 | A1 | 4/2002 | Kimura | |
| 2002/0140659 | A1 | 10/2002 | Mikami et al. | |
| 2002/0170968 | A1 | 11/2002 | Blake et al. | |
| 2002/0190256 | A1 | 12/2002 | Murakami et al. | |
| 2003/0057856 | A1 | 3/2003 | Yamauchi et al. | |
| 2003/0124042 | A1 | 7/2003 | Nakazawa et al. | |
| 2003/0129321 | A1 | 7/2003 | Aoki | |
| 2003/0214249 | A1 | 11/2003 | Kaneko et al. | |
| 2004/0164684 | A1 | 8/2004 | Inukai et al. | |
| 2004/0207331 | A1 | 10/2004 | Koyama | |
| 2004/0207615 | A1 | 10/2004 | Yumoto | |
| 2005/0067968 | A1 | 3/2005 | Yamashita | |
| 2005/0073241 | A1 | 4/2005 | Yamauchi et al. | |

FOREIGN PATENT DOCUMENTS

| | | | |
|---|---|---|---|
| CN | 1223014 | A | 7/1999 |
| EP | 1 130 565 | A1 | 9/2001 |
| JP | 61-138259 | | 8/1986 |
| JP | 63-250873 | | 10/1988 |
| JP | 02-039536 | | 2/1990 |
| JP | 05-142571 | | 6/1993 |
| JP | 5-249916 | | 9/1993 |
| JP | 08-54836 | | 2/1996 |
| JP | 08-129358 | | 5/1996 |
| JP | 10-079661 | | 3/1998 |
| JP | 10-170855 | | 6/1998 |
| JP | 10-199827 | | 7/1998 |
| JP | WO98/36407 | | 8/1998 |
| JP | 10-242835 | | 9/1998 |
| JP | 10-319872 | | 12/1998 |
| JP | 10-319872 | A | 12/1998 |
| JP | 11-111990 | | 4/1999 |
| JP | 11-219146 | | 8/1999 |
| JP | 11-237643 | | 8/1999 |
| JP | 11-260562 | | 9/1999 |
| JP | 2000-221903 | | 8/2000 |
| JP | 2000-236097 | | 8/2000 |
| JP | 2000-347621 | | 12/2000 |
| JP | 2000-349298 | | 12/2000 |
| JP | 2001-56667 | | 2/2001 |
| JP | 2001-60076 | | 3/2001 |
| JP | 2001-060076 | A | 3/2001 |
| JP | 2001-282136 | | 10/2001 |
| JP | 2001-308094 | | 11/2001 |
| JP | 2001-350449 | | 12/2001 |
| JP | 2002-040963 | | 2/2002 |
| JP | 2003-195811 | | 7/2003 |
| WO | WO 97/36324 | | 10/1997 |
| WO | WO 98/36407 | | 8/1998 |
| WO | WO 98/45881 | | 10/1998 |
| WO | WO 01/06484 | A1 | 1/2000 |
| WO | 2000-277607 | | 10/2000 |
| WO | WO 01/06484 | A1 | 1/2001 |
| WO | WO 01/75852 | A1 | 10/2001 |

OTHER PUBLICATIONS

United States Office Action for Related U.S. Appl. No. 10/359,571 mailed Dec. 13, 2005.

* cited by examiner

DRIVE CIRCUIT INCLUDING A PLURALITY OF TRANSISTORS CHARACTERISTICS OF WHICH ARE MADE TO DIFFER FROM ONE ANOTHER, AND A DISPLAY APPARATUS INCLUDING THE DRIVE CIRCUIT

BACKGROUND OF THE INVENTION

1. Field of the Invention

The present invention relates to a drive circuit and it particularly relates to a technology by which to reduce leakage current.

2. Description of the Related Art

As a trend in recent years, equipments including semiconductor devices are becoming smaller and lighter, and switching transistors to be implemented in such equipments are often mounted on semiconductor substrates. For example, thin film transistors (TFTs) are frequently used for unit equipments such as LCDs. Although various improvements have been made in the characteristics of TFTs, leakage current is a perpetual problem. For instance, a technology for improving storage characteristics is desired in order to store data over a reasonably long period of time.

The storage characteristics of transistors may be improved, for instance, by using longer gate length thereof, but this goes against the aforementioned trend toward smaller size of equipments. Moreover, the use of longer gates of transistors causes the problem of increased gate capacity and greater power consumption resulting therefrom.

SUMMARY OF THE INVENTION

The present invention has been made in view of the foregoing circumstances and an object thereof is to reduce the leakage current that occurs through a transistor from a target element. Another object of the present invention is to improve the storage characteristics of switching transistors to set and store data in a target element. Still another object of the present invention is to raise the current driving capability of switching transistors. Still another object of the invention is to realize smaller size and lower power consumption of switching transistors.

A preferred embodiment according to the present invention relates to a drive circuit. This circuit includes a plurality of transistors which set and store data in a target element, wherein the plurality of transistors are connected in series with each other, and wherein characteristics related to a current driving capability of at least one of the plurality of transistors are made to differ from those of other transistors. Here, the characteristics related to the current driving capability may be, for instance, a current amplification factor or on-resistance.

The transistors may be MOSFETs, and gate length of the at least one of transistors may be made to differ from that of other transistor.

The transistors may be MOSFETs, and gate width of the at least one of transistors may be made to differ from that of other transistor.

A plurality of transistors may be provided between a data supply source and the target element, and the current driving capability of the transistor provided at a side of the data supply source may be greater than that of the transistor provided at a side of the target element. The target element may be a driving transistor which controls drive current flowing to a diode or a current-driven type optical element. The target element may be a liquid crystal, a capacitance detector, or a memory.

Another preferred embodiment according to the present invention relates also to a drive circuit. This circuit includes a first transistor and a second transistor, both of which set and store data in a target element, wherein said first transistor and second transistor are connected in series with each other, and wherein gate width of the first transistor is narrower than that of the second transistor whereas gate length of the second transistor is shorter than that of the first transistor.

Another preferred embodiment according to the present invention relates to a display apparatus. This display apparatus includes a current-driven type optical element, a driving transistor which controls drive current flowing to the optical element, and a plurality of transistors which set and store data in the driving transistor, wherein the plurality of transistors are connected in series with each other, and wherein characteristics related to a current driving capability of at least one of the plurality of transistors are made to differ from those of other transistors. Here, the optical element may be an organic light emitting diode.

It is to be noted that any arbitrary combination of the above-described structural components and expressions changed between a method, an apparatus, a system and so forth are all effective as and encompassed by the present embodiments.

Moreover, this summary of the invention does not necessarily describe all necessary features so that the invention may also be sub-combination of these described features.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

FIRST EMBODIMENT

Figure 1:
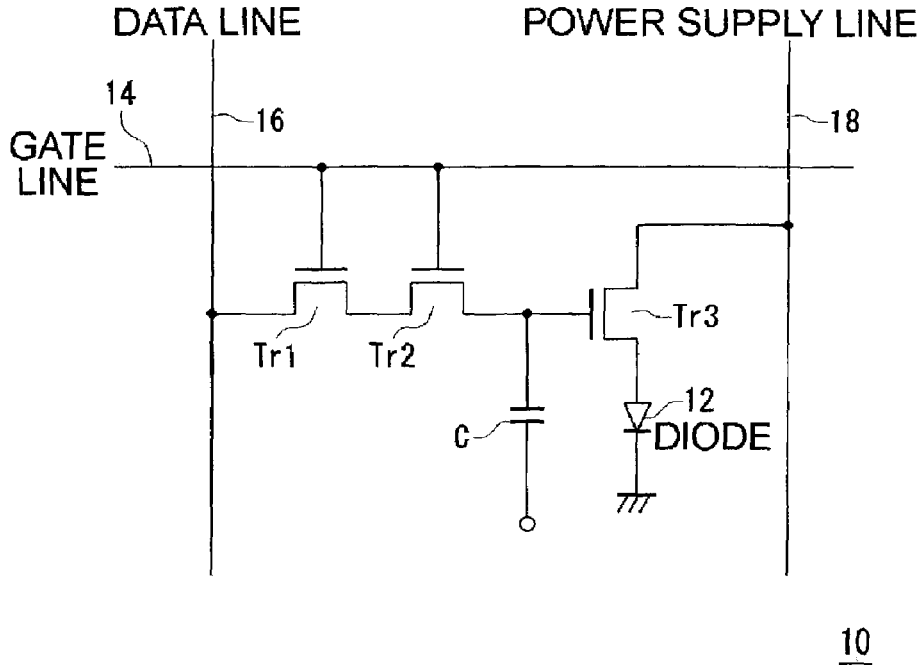
FIG. 1 shows a display apparatus including a drive circuit according to a first embodiment of the present invention.

FIG. 1 shows a display apparatus including a drive circuit according to a first embodiment of the present invention. In this first embodiment, a display apparatus 10 includes a first transistor Tr1, a second transistor Tr2, a third transistor Tr3, a capacitor C and a diode 12. The diode 12 is an optical element, such as an organic light emitting diode (OLED), functioning as a light emitting element.

The third transistor Tr3 is a driving TFT which controls the drive current flowing to the diode 12. The first transistor Tr1 and the second transistor Tr2 are also TFTs which serve as switches in setting and storing data in the third transistor Tr3. Moreover, the first transistor Tr1 and the second transistor Tr2 are connected with each other in series. By implementing this circuit structure mentioned above, the storage characteristics of transistors improves, so that the leakage current can be reduced. A circuit where two switching transistors are connected in series as described above is disclosed, for instance, in Japanese Patent Application Laid-Open No. 2000-221903. However, the Japanese Application Laid-Open No. 2000-221903 includes no description of the characteristics of those switching transistors or objects thereof.

In this first embodiment, the first transistor Tr1 and the second transistor Tr2 are so designed as to have different characteristics related to the current driving capability from each other. The characteristics related to the current driving capability are, for example, a current amplification factor β. The current amplification factor β is expressed as $\beta=\mu(C0x/2)\times(W/L)$, where μ is the effective mobility of a carrier, C0x is a capacity of gate oxide film per unit area, W is gate width, and L is gate length. In this first embodiment, the first transistor Tr1 and the second transistor Tr2 are so formed as to have different gate lengths or gate widths from each other. Thereby, the first transistor Tr1 and the second transistor Tr2 have different current amplification factors from each other.

The first transistor Tr1, the second transistor Tr2 and the third transistor Tr3 are represented here as n-channel transistors, but may be p-channel transistors as well.

A gate electrode of the first transistor Tr1 is connected to a gate line 14, a drain electrode (or a source electrode) of the first transistor Tr1 is connected to a data line 16, and the source electrode (or the drain electrode) of the first transistor Tr1 is connected to a drain electrode (or a source electrode) of the second transistor Tr2. A gate electrode of the second transistor Tr2 is connected to the gate line 14, and the source electrode (or the drain electrode) of the second transistor Tr2 is connected to a gate electrode of the third transistor Tr3 and one of electrodes of the capacitor C. The other of the electrodes of the capacitor C is set at a predetermined potential. The data line 16 is connected to a constant-current source, and sends luminance data that determines the current that flows to the diode 12.

The drain electrode of the third transistor Tr3 is connected to a power supply line 18, and the source electrode of the third transistor Tr3 is connected to an anode of the diode 12. A cathode of the diode 12 is grounded. The power supply line 18 is connected to a power supply (not shown) and a predetermined voltage is applied to the power supply line 18.

In the first embodiment, there are four approaches or structures, as shown below, to have the current amplification factors of the first transistor Tr1 and the second transistor Tr2 different from each other:

(1) making the gate length of the first transistor Tr1 shorter than that of the second transistor Tr2;

(2) making the gate length of the second transistor Tr2 shorter than that of the first transistor Tr1;

(3) making gate width of the first transistor Tr1 narrower than that of the second transistor Tr2; and (4) making gate width of the second transistor Tr2 narrower than that of the first transistor Tr1.

Each of these four approaches or structures have merits as described in the following:

(1) By making the gate length of the first transistor Tr1 shorter than that of the second transistor Tr2, there will arise the merit of increased current amplification factor, smaller size and lower power consumption of the first transistor Tr1 while retaining the storage characteristics of the second transistor Tr2. Moreover, by keeping a high level of storage characteristics of the second transistor Tr2, which is directly connected to the third transistor Tr3, the leakage current from the third transistor Tr3 can be reduced and the gate potential of the third transistor Tr3 can be maintained more accurately.

(2) By making the gate length of the second transistor Tr2 shorter than that of the first transistor Tr1, there will arise the merit of reduced gate capacity required of the second transistor Tr2 while retaining the storage characteristics of the first transistor Tr1. This reduces the effect of the gate capacity of the second transistor Tr2 on the gate potential of the third transistor Tr3 and enables to maintain the gate potential of the third transistor Tr3 more accurately.

(3) By making the gate width of the second transistor Tr2 narrower than that of the first transistor Tr1, the storage characteristics of the second transistor Tr2 can be further improved while retaining the current amplification factor of the first transistor Tr1. Moreover, by keeping a high level of storage characteristics of the second transistor Tr2, which is directly connected to the third transistor Tr3, the leakage current from the third transistor Tr3 can be reduced and the gate potential of the third transistor Tr3 can be maintained more accurately.

(4) By making the gate width of the first transistor Tr1 narrower than that of the second transistor Tr2, the storage characteristics of the second transistor Tr2 can be further improved while retaining the current amplification factor of the second transistor Tr2.

In the first embodiment, any approaches or structures described above can be carried out to optimize a target display apparatus by taking into consideration the merits of those approaches or structures.

Moreover, various combinations of the above approaches or structures are also possible. For example, the structure of (1) may be combined with the structure of (4), or the structure of (2) may be combined with the structure of (3). By these combinations, both the transistors can be made smaller and lower power consumption can be realized by the reduction in gate capacity. Moreover, there will arise the merit that the current amplification factor of one transistor can be made higher while at the same time the storage characteristics of the other transistor can be improved. Besides, the storage characteristics can be further improved because the two switching transistors are connected in series with each other.

SECOND EMBODIMENT

Figure 2:
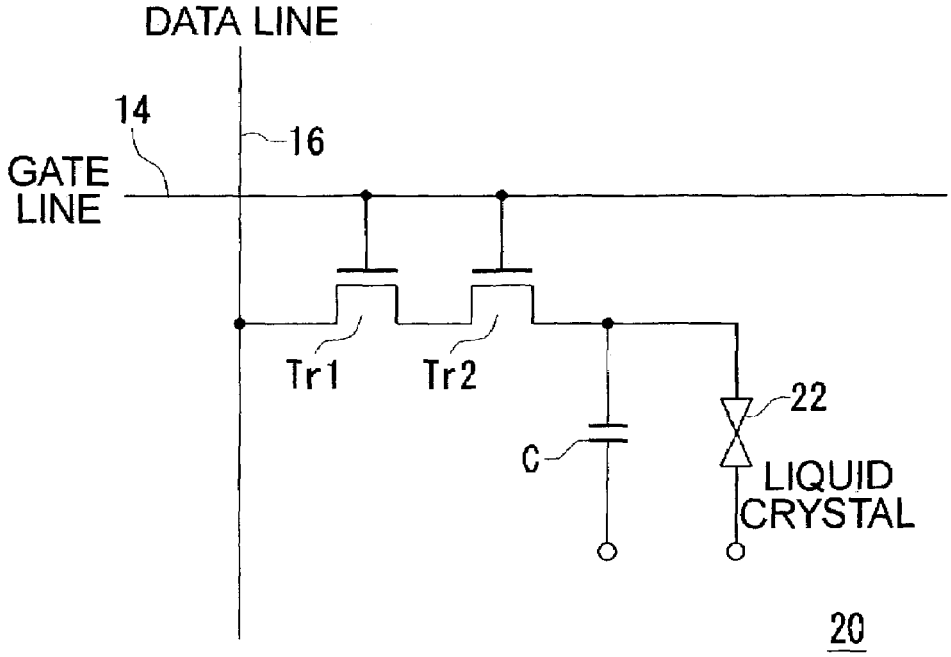
FIG. 2 shows a drive circuit according to a second embodiment of the present invention.

FIG. 2 shows a drive circuit according to a second embodiment of the present invention. The second embodiment differs from the first embodiment in that a drive circuit 20 includes a liquid crystal 22 in substitution for the third transistor Tr3 and the diode 12 in the display apparatus 10 according to the above-described first embodiment. In the following description, therefore, the components identical to those in the first embodiment are designated by the same reference numerals, and the description therefor will be omitted as appropriate. The liquid crystal 22 is connected to a drain electrode (or a source electrode) of a second transistor Tr2.

In the second embodiment, too, the transistors may be designed in such a manner that the first transistor Tr1 and the second transistor Tr2 have different current driving capabilities from each other. In this case, too, any approaches or structures described in the first embodiment above can be carried out to optimize a target drive circuit related to the current driving capability of the transistors by taking into consideration the merits of those approaches or structures.

THIRD EMBODIMENT

Figure 3:
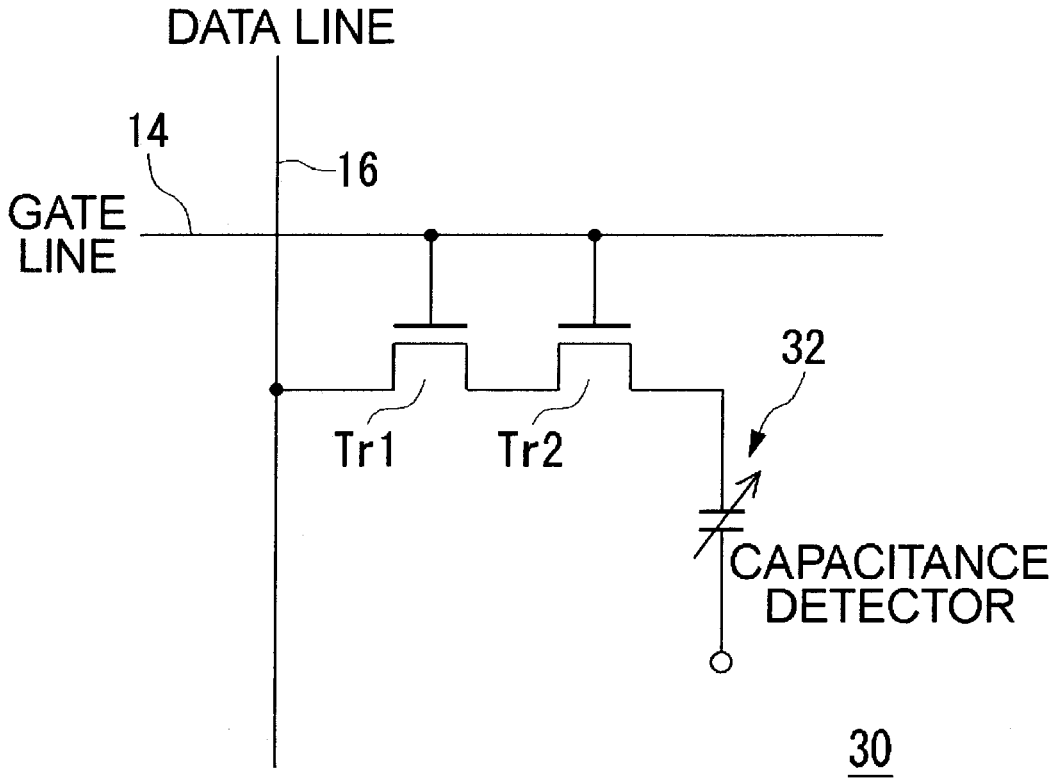
FIG. 3 shows a drive circuit according to a third embodiment of the present invention.

FIG. 3 shows a drive circuit according to a third embodiment of the present invention. This third embodiment differs from the first embodiment in that a drive circuit 30 includes a capacitance detector 32 in substitution for the third transistor Tr3 and the diode 12 in the display apparatus 10 according to the first embodiment.

A capacitance detector 32 is connected to a drain electrode (or a source electrode) of the second transistor Tr2. The capacitance detector 32 is, for instance, any of various sensors.

In the third embodiment, too, any approaches or structures described in the first embodiment above can be carried out to optimize a target drive circuit related to the current driving capability of the transistors by taking into consideration the merits of those approaches or structures.

FOURTH EMBODIMENT

Figure 4:
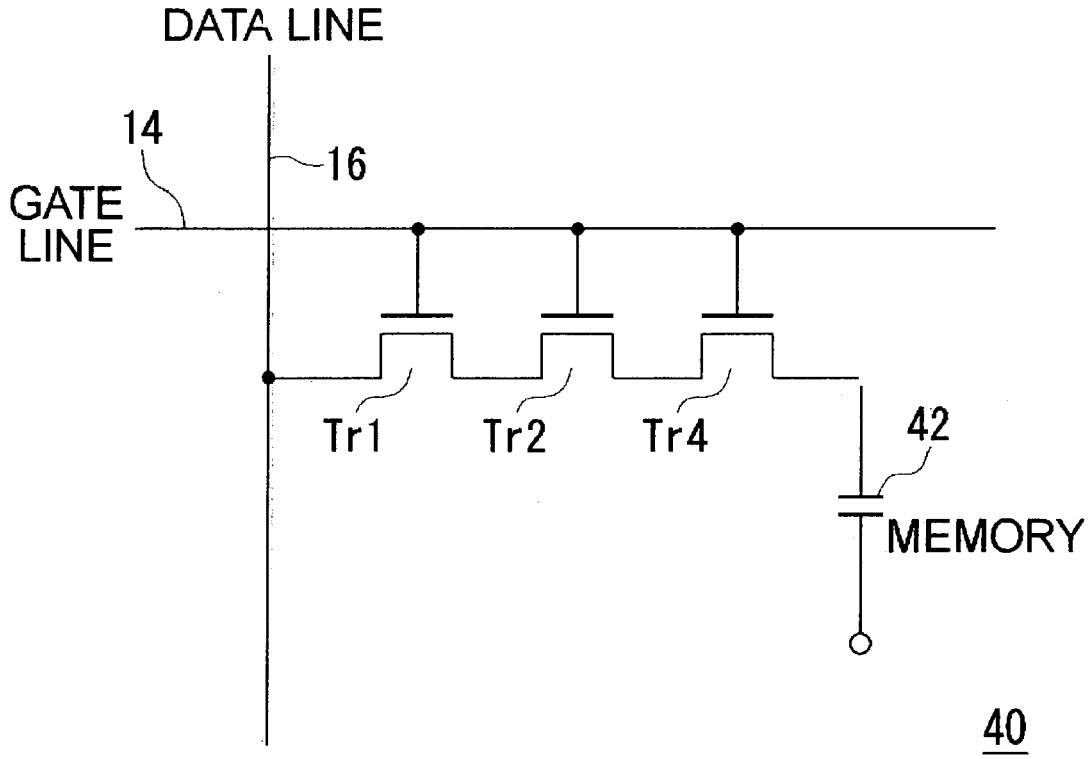
FIG. 4 shows a drive circuit according to a fourth embodiment of the present invention.

FIG. 4 shows a drive circuit according to a fourth embodiment of the present invention. This fourth embodiment differs from the first embodiment in that a drive circuit 40 includes a memory 42 in substitution for the third transistor Tr3 and the diode 12 in the display apparatus 10 according to the first embodiment. Moreover, the drive circuit 40 further includes a fourth transistor which is a switching TFT.

One of electrodes of the memory 42 is connected to a drain electrode (or a source electrode) of a second transistor Tr2, whereas the other of the electrodes of the memory 42 is set at a predetermined potential.

In this fourth embodiment, the first transistor Tr1, the second transistor Tr2 and the fourth transistor Tr4 may be designed such that at least one of the transistors has characteristics related to the current driving capability different from those of the others. In this case, too, any approaches or structures described in the first embodiment above can be carried out to optimize a target drive circuit related to the current driving capability of the transistors by taking into consideration the merits of those approaches or structures.

The present invention has been described based on embodiments which are only exemplary. It is understood by those skilled in the art that there exist other various modifications to the combination of each component and process described above and that such modifications are encompassed by the scope of the present invention. Such modified examples will be described hereinbelow.

The display apparatus described in the first embodiment, and the drive circuit described in the second and third embodiment of the present invention may also include three switching transistors in the similar manner as described in the fourth embodiment. Moreover, all the preferred embodiments as described above may include a still greater plurality of switching transistors.

The thickness of a gate insulator or an ion dose into the gate electrode may also be changed in order to realize different characteristics related to the current driving capability of a plurality of transistors.

Although the present invention has been described by way of exemplary embodiments, it should be understood that many changes and substitutions may further be made by those skilled in the art without departing from the scope of the present invention which is defined by the appended claims.

What is claimed is:

1. A drive circuit, including a plurality of transistors which set and store data in a target element, wherein said plurality of transistors are connected in series with each other, and wherein characteristics related to a current driving capability of at least one of said plurality of transistors are made to differ from those of other transistors; and wherein said plurality of transistors are provided between a data supply source and said target element, and wherein the current driving capability of the transistor provided at a side of said data supply source is greater than that of the transistor provided at a side of said target element.

2. A drive circuit according to claim 1, wherein said plurality of transistors are MOSFETs, and wherein gate length of said at least one of transistors is made to differ from that of other transistors.

3. A drive circuit according to claim 1, wherein said plurality of transistors are MOSFETs, and wherein gate width of said at least one of transistors is made to differ from that of other transistors.

4. A drive circuit according to claim 1, wherein said characteristic related to the current driving capability is current amplification factor.

5. A drive circuit according to claim 1, wherein said target element is a driving transistor which controls drive current flowing to a diode.

6. A drive circuit according to claim 1, wherein said target element is a driving transistor which controls drive current flowing to a current-driven type optical element.

7. A drive circuit according to claim 1, wherein said target element is a liquid crystal.

8. A drive circuit according to claim 1, wherein said target element is a capacitance detector.

9. A drive circuit according to claim 1, wherein said target element is a memory.

10. A drive circuit, including a first transistor and a second transistor, both of which set and store data in a target element, wherein said first transistor and said second transistor are connected in series with each other, and wherein gate width of said first transistor is narrower than that of said second transistor whereas gate length of said second transistor is shorter than that of said first transistor; and wherein said first transistor and said second transistor are provided between a data supply source and said target element, and wherein said second transistor is provided at a side of the data supply source.

11. A drive circuit according to claim 10, wherein said target element is a driving transistor which controls drive current flowing to a diode.

12. A drive circuit according to claim 10, wherein said target element is a driving transistor which controls drive current flowing to a current-driven type optical element.

13. A drive circuit according to claim 10, wherein said target element is a liquid crystal.

14. A drive circuit according to claim 10, wherein said target element is a capacitance detector.

15. A drive circuit according to claim 10, wherein said target element is a memory.

16. A display apparatus, including:

a current-driven type optical element;

a driving transistor which controls drive current flowing to said optical element; and a plurality of transistors which set and store data in said driving transistor, wherein said plurality of transistors are connected in series with each other, and wherein characteristics related to a current driving capability of at least one of said plurality of transistors are made to differ from those of other transistors; and wherein said plurality of transistors are provided between a data supply source and said driving transistor, and wherein the current driving capability of the transistor provided at a side of the data supply source is greater than that of the transistor provided at a side of said driving transistor.

17. A display apparatus according to claim 16, wherein said optical element is an organic light emitting diode.

18. A display apparatus according to claim 16, wherein said plurality of transistors are MOSFETs and wherein gate length of said at least one of transistors is made to differ from that of other transistors.

19. A display apparatus according to claim 16, wherein said plurality of transistors are MOSFETs and wherein gate width of said at least one of transistors is made to differ from that of other transistors.

* * * * *